US009561403B2

(12) United States Patent
Vilar et al.

(10) Patent No.: US 9,561,403 B2
(45) Date of Patent: Feb. 7, 2017

(54) APPARATUS AND SYSTEM FOR AUTOMATIC COLLECTION AND DELIVERY OF SPHERICAL GAME ELEMENTS

(71) Applicant: Foxtenn Bgreen, S.L., Barcelona (ES)

(72) Inventors: Javier Simon Vilar, Barcelona (ES); Fernando Gonzalez Minguez, Barcelona (ES)

(73) Assignee: Foxtenn Bgreen, S.L., Barcelona (ES)

( * ) Notice: Subject to any disclaimer, the term of this patent is extended or adjusted under 35 U.S.C. 154(b) by 0 days.

(21) Appl. No.: 14/808,617

(22) Filed: Jul. 24, 2015

(65) Prior Publication Data

US 2015/0328503 A1 Nov. 19, 2015

Related U.S. Application Data

(63) Continuation-in-part of application No. 13/521,984, filed as application No. PCT/IB2011/050079 on Jan. 10, 2011, now Pat. No. 9,089,742.

(30) Foreign Application Priority Data

Jan. 12, 2010 (ES) ..... 201030018

(51) Int. Cl.
*A63B 69/00* (2006.01)
*A63B 47/02* (2006.01)
(Continued)

(52) U.S. Cl.
CPC ..... *A63B 47/021* (2013.01); *A63B 71/0009* (2013.01); *A63B 2047/022* (2013.01);
(Continued)

(58) Field of Classification Search
None
See application file for complete search history.

(56) References Cited

U.S. PATENT DOCUMENTS 4,116,436 A * 9/1978 Bjorhn ..... A63B 47/024 473/460
4,568,089 A 2/1986 Jenkins et al.
(Continued)

FOREIGN PATENT DOCUMENTS

DE 19711298 A1 9/1998
WO WO-2007098537 A1 9/2007
WO WO-2009022929 A2 2/2009

OTHER PUBLICATIONS

Suzanne Dunphy, Beverage Acquiring Robot (B.A.R.), Dec. 11, 2003, Georgia Institute of Technology, pp. 5-19.*
(Continued)

*Primary Examiner* — Tramar Harper
(74) *Attorney, Agent, or Firm* — Honigman Miller Schwartz and Cohn LLP

(57) ABSTRACT

A collection apparatus including an autonomous power supply means and an image acquisition means for acquiring image sequences of at least one area of surveillance is disclosed. The collection apparatus may further include control means connected to the image acquisition means for receiving and processing the acquired sequences of images, to detect the presence and position of said game elements, and to send a control command to move the collection apparatus to collect a detected spherical game element. The collection apparatus also includes interaction means for interacting with a player to deliver a previously collected spherical game element to the player and a delivery device controlled by the control means to perform the delivery. An automatic collection system is also disclosed that uses two collection apparatuses, operating in a complementary and/or synchronized way to collect and deliver a spherical element to a player, on request by the player.

8 Claims, 1 Drawing Sheet

(51) Int. Cl.
*A63B 71/00* (2006.01)
*A63B 71/06* (2006.01)

(52) U.S. Cl.
CPC ... *A63B 2071/0625* (2013.01); *A63B 2102/02* (2015.10); *A63B 2220/805* (2013.01); *A63B 2220/806* (2013.01); *A63B 2225/50* (2013.01)

(56) References Cited

U.S. PATENT DOCUMENTS 7,674,196 B2 * 3/2010 Tsai ..... A63B 47/021 414/440
2004/0142766 A1 * 7/2004 Savarese ..... A63B 24/0021 473/353
2006/0118096 A1 6/2006 Cucjen et al.
2006/0287801 A1 * 12/2006 Im ..... A47L 9/2805 701/99
2007/0021226 A1 * 1/2007 Tyroler ..... A63B 71/06 473/131
2007/0298898 A1 * 12/2007 Kiraly ..... A63B 69/3658 473/131
2008/0032828 A1 * 2/2008 Alger ..... A63B 69/406 473/446
2008/0183347 A1 * 7/2008 Miki ..... B60L 15/2045 701/22
2008/0262669 A1 10/2008 Smid et al.
2008/0312010 A1 * 12/2008 Marty ..... A63B 24/0003 473/447
2009/0067670 A1 * 3/2009 Johnson ..... A63B 71/0605 382/100
2010/0250024 A1 * 9/2010 Macedo Ribeiro .. A63B 47/021 701/2
2012/0215355 A1 * 8/2012 Bewley ..... B25J 5/005 700/258

OTHER PUBLICATIONS

Jorg Stuckler and Sven Behnke, Integrating Indoor Mobility, Object Manipulation, and Intuitive Interaction for Domestic Service Tasks, Dec. 2009, 9th IEEE-Ras International Conference on Humanoid Robots (Humanoids), pp. 3 and 6.*
International Search Report dated Jul. 18, 2011 relating to International Application No. PCT/IB2011/050079.
Non-Final Office Action by the U.S. Patent and Trademark Office dated Jun. 4, 2014, relating to U.S. Appl. No. 13/521,984.
Final Office Action by the U.S. Patent and Trademark Office dated Dec. 31, 2014, relating to U.S. Appl. No. 13/521,984.

* cited by examiner

APPARATUS AND SYSTEM FOR AUTOMATIC COLLECTION AND DELIVERY OF SPHERICAL GAME ELEMENTS

CROSS REFERENCE TO RELATED APPLICATIONS

This U.S. patent application is a continuation-in-part application of, and claims priority under 35 U.S.C. §120 from, U.S. patent application Ser. No. 13/521,984, filed on Jul. 12, 2012, which is the National Stage of International Application No. PCT/IB2011/050079, filed on Jan. 10, 2011, which was assigned a priority date of Jan. 12, 2010. The disclosures of these prior applications are considered part of the disclosure of this application and are hereby incorporated by reference in their entireties.

TECHNICAL FIELD

This disclosure relates to a movable apparatus for the automatic collection and controlled individual delivery of spherical game elements such as a ball in a game and to a system including at least two such apparatuses operating in a controlled coordinated manner.

BACKGROUND

Application WO-A-2009022929 describes an automatic golf ball collection system that can function autonomously or remotely controlled. It includes an artificial vision system to detect the balls to be collected, and a processing system which processes the images acquired by the artificial vision system, and which individually controls motors which move a collection vehicle, defining a path to be followed according to the detections found in the images. Several operational modalities are proposed with reference to the path to be followed by the collection vehicle e.g. it has to pass along some designated control points or control locations which are previously defined by a positioning system (for example GPS) of the own collection systems. The system provides the installation of a great variety of sensors which allow it to avoid all kind of obstacles and irregularities of the field (since it is intended for outdoor use: in particular for a golf course), as well as to return to the base station if weather conditions are adverse.

DE-A-19711298A discloses a method and a device for the detection and automatic collection of objects, such as tennis balls, with a computing system including an opto-electric detection system comprising one camera, a laser scanner or a sonar sensor that, depending on the application, even can be combined. The device analyzes the surroundings, it detects the elements to be collected, and it determines the collection trajectory, along which the device can redirect its path to avoid obstacles or to choose an alternative itinerary In US-A-20080189004, a vehicle for ball collection in a golf course is disclosed, which follows either one balls collection trajectory or another one based on the information relative to the balls distribution on the field. The information can be acquired by means of a visual sensor located on the vehicle itself or on a remote unit. Its specification indicates that collection of other types of balls can be a performed, such as those for tennis. In EP-B 0372249, a device to collect tennis balls in an automatic way is proposed, as well as to smooth the playing surface by means of a brush.

In the cited applications, possible interaction of the ball collection apparatus or device with the player is unsolved or insufficiently developed, whereby the possibility for the device to deliver the game balls or balls to the player and generally the response time is deficient to use the application in a game dynamic without imposing restraints or excessive changes. The purpose of this invention solves such deficiencies.

SUMMARY

The present invention relates to a movable apparatus for the automatic collection and controlled individual delivery of spherical game elements such a ball in a game. The invention also relates to a system comprising at least two of the cited apparatus that operate in a controlled coordinated manner. For clarity of the following explanation, in the present application the game area will be intended to be that zone of a game surface or game field where the impact or fall of the ball is considered as being valid, according to the rules of a game. Likewise the game surface will be intended to be the game field as a whole including a zone surrounding the cited game area, where mainly ball collection apparatuses will operate.

One aspect of the disclosure provides a movable apparatus for the automatic collection and controlled individual delivery of spherical game elements such as a ball and in particular a tennis ball.

The disclosed movable apparatus includes an autonomous power supply means (for instance an electric motor assisted by an electric battery), an image acquisition device (such as a camera) for acquiring image sequences of at least one area of surveillance, a control device, interaction means, and delivery means (such as a throwing or launching element). The control device is based on a computer device connected to the image acquisition means for receiving the acquired sequences of images, for processing at least part of the sequences of images to detect the presence and position of at least one spherical game element in the surveillance area, for sending a control command to move the apparatus to the position of the at least one detected spherical game element, and for instructing the apparatus to collect the detected spherical game element. The interaction means includes at least a recognition device capable of interacting with a player to perform a controlled and individual delivery of a previously collected spherical game element to a said player. The delivery means, which is controlled by the control device, performs the controlled and individual delivery of a previously collected spherical game element to the player The movable apparatus of this disclosure also performs the delivery of the spherical element to the player—on request of the player or in an automatic manner (such as a prefixed command by a user)—from a collection point. To accomplish this, the movable apparatus approaches the player up to a determined distance, or it is accomplished via an intermediate delivery mechanism selected between a ball launcher machine, a ball storage deposit with auxiliary launcher device, and a ball dispenser at a determined height with manual collection by the player, to whom said collection apparatus delivers the ball. Following this delivery, the movable apparatus returns to a given position or starts another collection. Notably, the apparatus and system of this invention are devised to implement a method disclosed in the co-pending U.S. patent application 2013/0210556 (application Ser. No. 13/521,984), which is fully incorporated herein by reference.

According to the invention, a player request can be performed by means of several communication ways, vocal, gestural, by a wireless device, or by combination of these ones. This particularity allows the method to be applicable to players with different disabilities, elderly people, or those who require different arrangements, in some way specific for the practice of the game that the method allows to take place.

The collection apparatus, which is at least one, is situated at a game area, is situated close to a game area, or after the spherical element delivery returns to a game area in which by means of statistical calculations of a game or of a series of games previously played by one or more players, it has been established that a greater number of spherical game elements will impact or fall. This condition leads to greater efficiency of the movement of the collection apparatus, because after the delivery of the ball it will go unless otherwise instructed towards an area more likely for spherical elements to impact or fall, facilitating the collection.

One implementation of the invention provides a system with at least two collection apparatuses, which operate in a complementary manner performing the collection or delivery of the spherical elements and moving in a coordinated and/or synchronous way in order to optimize the delivery time to the player of a spherical element following its collection. The two apparatuses share the collection and/or delivery tasks. A first one of the at least two collection apparatuses may move towards a predetermined area chosen between one of the cited areas of impact or fall of the spherical game elements (which can have been calculated by means of trajectories detection, or it may be statistically provided), while a second apparatus performs a collection or delivery.

Relatively to the method—of the incorporated herein co-pending U.S. Patent Application (US 2013/0210556)—for the automatic collection and delivery of spherical game elements, such as a tennis ball of the present invention, in step b)—analyzing the images to detect the presence of at least one spherical game element in said surveillance area—the disclosure allows for an analysis of the images of any zone of the game surface so as to detect any other objects or people which are present in said area of surveillance, both with reference to their position as well as with reference to the fact that they are still or they are moving, allowing to acquire their movements. Furthermore, this step b) comprises the calculation of the movement trajectory of the ball, referred to in step c)—moving a collection apparatus of spherical game elements to the location of the detected spherical game element, which is at least one, and proceed to collect it—as a function of the detected objects and/or of the position of the player with respect to the spherical element at the time of its stroke or hit or prior to it.

By means of the cited strategy it is possible to immediately inform the collection apparatus, about the zone in which the ball is going to fall, or it is even possible to indicate to the collection apparatus to perform movements to avoid or to try to avoid a ball, in order to maintains a safety distance in case of persons, and so that, in any case, the collection apparatus arrives as fast as possible at the location of the spherical game element or ball to be collected.

According to an additional characteristic it has also been provided that in the above-reference step b) of the incorporated co-pending application, the collection apparatus proceeds to detect the presence of a plurality of spherical game elements to be collected in the surveillance area, and an optimal itinerary is calculated, in time and distance, for its collection in a shared way by the collection apparatuses which are at least two and which are initially located (when the game begins) at a lateral or end zone of a tennis court, finally performing at the end the above-referenced step c) to collect all the spherical game elements.

The disclosed movable collection apparatus may operate in such a way that it delivers the ball by sliding on the game surface, launching it to perform at least a bounce before reaching the player, or throwing it at a determined height depending on the particular characteristics of the player in order to enable the game to be adapted to people with disabilities or physical deficiencies, calculating for this purpose the distance from the delivery point to the player and the receiving conditions. The collection apparatus may also approaches a point close to the player so that he can receive the ball practically in the hand.

As indicated, this disclosure also refers to a system for the automatic collection of spherical game elements such as a ball and in particular a tennis ball, of the type that includes images acquisition means, a collection apparatus, and control means.

The images acquisition means acquire image sequences of at least one area of surveillance. The collection apparatus of spherical game elements move and collect spherical game elements, in an automatic way. The control means connect with the acquisition and image processing means and communicate with the spherical game element collection apparatus. Further, the control means process at least part of the images to detect the presence of at least one spherical game element in the surveillance area. And the control means send a control command to the spherical game element collection apparatus so that it moves to the location of the detected spherical game element, which is at least one, and, then, the spherical game element collection apparatus proceeds to collect the at least one spherical game element.

The system of the present invention, in addition, includes at least two collection apparatuses provided to operate in a complementary and/or synchronized way so as to perform said collection tasks, associated to the control means. Each of said apparatuses is able to perform a delivery of the collected spherical element to the player in response to a request from him. The at least two collection apparatuses operate in a complementary and/or synchronized way during the delivery tasks.

Such collection apparatuses have small dimensions facilitating the transportation of the system including optional cameras for the surveillance of the playing surface, although already installed cameras on the playing course can be used.

Finally, the disclosure incorporates the particular characteristics of one of the two used collection apparatuses, advantageously, in the cited system, and which integrate means to interact with a player to perform a controlled delivery to a player of the collected spherical object, or go and collect a determined spherical element, in response to an order given by the same by means of a vocal order, gestural order, electronic device or by means of a combination of these means.

Other characteristics and particularities of the present disclosure will be apparent with greater clarity in the following detailed explanation of an exemplary embodiment, applied to a tennis court, which is provided as a non-limiting example.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

Figure 1:
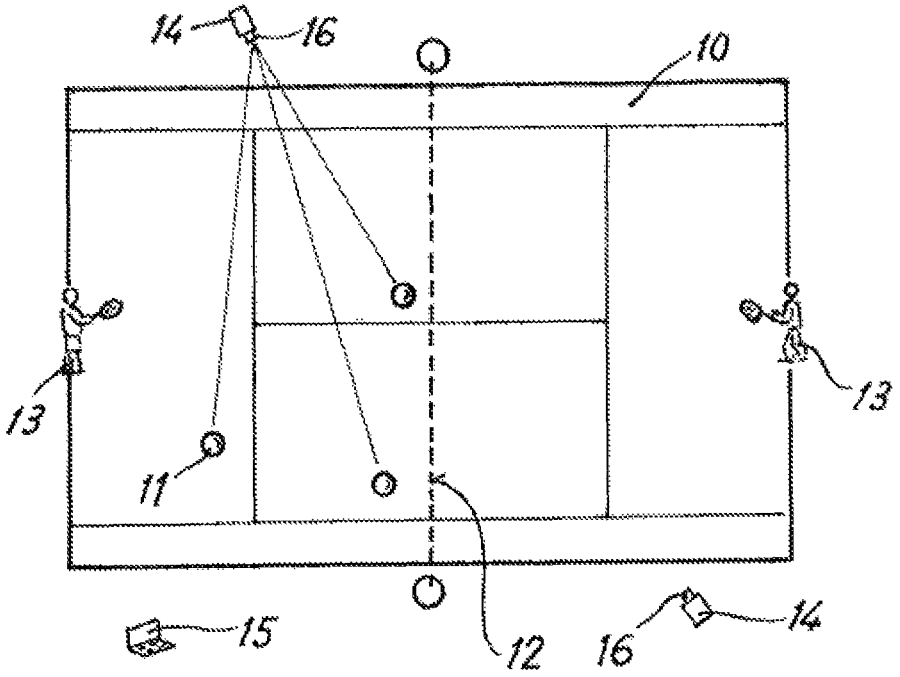
FIG. 1 is a schematic plan view of a tennis court including references to the various components necessary to implement a basic version of the invention.

In FIG. 1 a tennis court 10 can be seen, with an intermediate separation net 12, a plurality of tennis balls 11 being associated to it, which are randomly distributed in the field of one of the two or more players 13. The invention proposes the utilization of a ball collection apparatus 14, preferably using two of such apparatuses 14 arranged in a lateral zone or next to each end or game surface which surrounds the court 10. These apparatuses 14 are remotely controlled (wireless communication, standard means) by one or more control units 15 (implemented in the present case by a local computer which can be a notebook). In an implementation of the invention the cited one or more control units 15 can be integrated in one or in both the apparatuses 14. The cited computer or computers receive information concerning the location of the balls 11 from a series of cameras 16 (their position can be diverse located in the sides and/or ends of the game surface or field or even hanging above the game area). A distinctive characteristic of the method disclosed in cited US co-pending patent 2013/0210556 and of the system of this disclosure is that said information about the balls 11, not only includes positional information, but it is indicative of the trajectory of the same (and thus it is indicative of a fall or impact zone of the ball 11), and even of the relationship between a part of the player and the ball during the impact of a racket with the same as well as prior to said impact. As soon as disclosed system can capture information indicating that a ball can go out of the game area, this information is sent to one of the apparatuses 14, which initiates a movement for its collection and subsequent delivery to the player 13.

Figure 2:
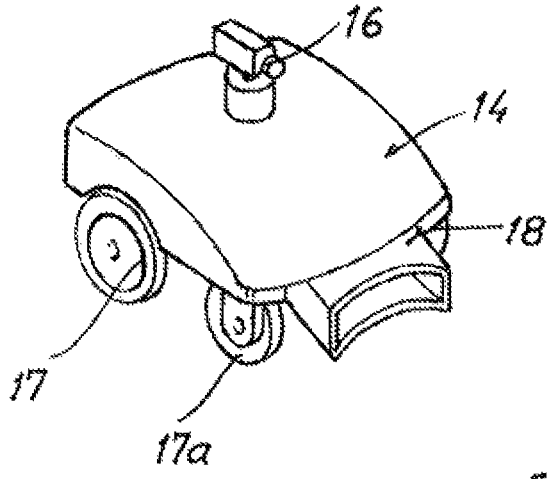
FIG. 2 is a perspective view of a possible apparatus for the automatic collection and delivery of spherical elements.

FIG. 2 shows a possible non-limiting implementation of a ball collection apparatus 14, in accordance with the principles of this disclosure, which in the present invention includes a device provided with driving wheels 17 and steering wheels 17*a*, provided with a front portion 18 intended to embrace and retain a ball, e.g., via suction through some slits, although other known systems can be used (pair of adjacent rotating rollers, rotating brushes, etc.).

The apparatus 14 is equipped with at least one camera 16 provided for inspection of the game field or surface, of the player and his gestures or other people and their means of interaction, or others objects which are present at a given time in the game surface, and able to provide additional information to a control unit 15 about the location of the balls 11 to be collected.

In the particular case in which the ball impacts the net and remains attached to it, the collection apparatus 14 have been provided to have some specific actuation means in that area going to the point where the ball is located and shaking the net or capturing the ball 11, e.g., with some means of grabs. In the case of the collection apparatus 14 represented in FIG. 2, as a mere and, hence, non-limitative example, the delivery of the ball 11 will occur by sliding on the game surface and by striking it utilizing a means of a throwing or launching element associated to the collection head.

It has also been provided that the apparatus 14 can deliver the ball in an automatic way, from some prefixed positions, e.g., next to the player, following an established command from the player or it can also approach the player and only delivers the ball 11 following his request.

The illustrated apparatus 14 or another similar one (with adaptations to transfer and manipulate the balls) can also deliver the ball 11 to an intermediate device (not illustrated) which either: 1) will launch it to realize at least one bounce before reaching the player; or 2) will throw it at a determined height according to the particular player characteristics in order to adapt to people with disabilities or physical deficiencies, calculating for this purpose the distance from the delivery point to the player of and receiving conditions. As indicated, the apparatus can provide a delivery approaching the player 13, and can provide him the ball in his hand 13.

The apparatus 14 for the automatic collection of balls 11 is provided to move by means of its wheels 17, 17*a*, towards a zone wherein the control means 15, in connection with the image acquisition means have detected the presence of at least one ball 11, or that the zone is going to receive the impact or fall of a ball 11, given its trajectory. For this purpose the apparatus 14 is provided with some self-powered means such as a rechargeable battery.

The apparatus 14 includes means to interact with a player (luminous, acoustic signals, etc. and to receive commands: acoustic sensors, camera 16, etc.) to perform a controlled delivery of the collected spherical object to a player, or to go to find a determined spherical object, in response to a command given by said player, by means of a vocal, gestural command, an electronic device or a combination of said means.

In particular the means by which the apparatus 14 interacts with a user include a recognition system of the speech, of gesture commands, or of luminous or wave signals, able to interpret verbal or gestural commands, or signals emitted by said user as control commands and an audio system has been provided in the apparatus to emit sounds and/or phrases and/or music selectable by means of said control means depending on the operating status of the apparatus.

In this way the apparatus 14 goes towards the ball 11 as quickly as possible, and, once it has reached the ball, proceeds to collect and place the ball 11 in a delivery or throwing position. At this point the player 13 can decide if he wants the apparatus 14 to pass him the ball 11 and to return to a determined point or base, or if he wants the apparatus 14 to go to its base and wait for a request for a ball 11, from the player 13.

The apparatus 14 can be equipped with some brushes to perform auxiliary tasks such as cleaning an area of the court, as well as with elements to mark some lines delimiting the different zones of the game area.

With reference to the system to implement the invention, the same is mainly characterized in that it includes at least two collection apparatuses 14 provided to operate in a complementary and/or synchronized way to perform said collection and/or delivery tasks, associated to said means of control each of said apparatuses 14 is provided to be able to perform a delivery of the collected ball 11 to the player, in response to a request thereof, said at least two apparatuses operating in a complementary and/or synchronized way during said collection and delivery tasks.

Instead of providing the apparatus 14 to deliver a previously collected ball 11 to the player 13 in response to a request by said player 13, it has being provided that the player 13 can determine by means of a previously established command, the apparatus 14 to automatically operate delivering the balls 11, to the player 13, after their collection, e.g., from a predetermined launch point, as long as the player 13 does not establish for it to returned to a delivery of the ball on request.

The provided collection apparatuses 14 integrate, as shown in FIG. 2, at least one image acquisition device, selected from a CCD camera, a video camera, or another image capturing device, known by itself, and because there is an intercommunication between said collection apparatuses which are at least two, to cover, in a complementary way different areas of the game surface or hidden areas for one of the two cameras, with the contribution of said control means.

For a proper implementation of the described method the use of at least one fixed camera (not represented, since its position can be very different) which serves said game surface has also been provided, said control means 15 receiving visual information from said mobile cameras 16 fixed to the collection apparatuses 14 and from said fixed camera, which is at least one. In a preferred embodiment one or more additional rotating head cameras (not represented) have been also provided, intended to follow the player to acquire his movements, providing different angles and allowing the capture of images of different players on the court, or areas where the ball bounces, etc. Advantageously two such rotating head cameras, one for each player 13, will be used.

The control means comprise a first electronic system (located in local control units 15) separate from the balls 11 collecting apparatus 14 and a second electronic system carried by said apparatus 14, both electronic systems communicating the one with the other by means of a wireless communication. As indicated, said control means could be integrated in an alternative embodiment, as a whole, in the collection apparatuses 14 themselves without the need for a separate local unit. Generally, at least one of said electronic systems will include a memory to register some historical data relative to the operation of the system as whole, including images and statistical information. In this way all the apparatuses 14 and all the vision devices (mobile and fixed cameras) are programmable and can dump all the statistical information and images of their activity.

It has likewise been provided the invention system to be arranged as a portable set, integrating transport means of its components. The system can use previously installed cameras for its implementation in a tennis court, for transmission of the matches or training studies.

A number of implementations have been described. Nevertheless, it will be understood that various modifications may be made without departing from the spirit and scope of the disclosure. Accordingly, other implementations are within the scope of the following claims.

What is claimed is:

1. A system for the automatic collection and controlled individual delivery of spherical game elements in a surveillance area having a gaming area, the system comprising:

an opto-electric detection and acquisition device adapted to acquire image sequences or detect data about the surveillance area;

a first movable automatic spherical game element collection apparatus;

a second movable automatic spherical game element collection apparatus in communication with the first movable automatic spherical game element collection apparatus; and first control means for analyzing and processing said image sequences or data to identify the presence of at least one spherical game element in said surveillance area and for sending control commands to one or both of the first and second movable automatic spherical game element collection apparatuses so that the apparatuses operate in one or both of a complimentary and synchronous manner to collect the one or more spherical game elements, wherein each of said first and second movable automatic spherical game element collection apparatuses comprises:

an autonomous power supply means;

image acquisition device for acquiring image sequences of at least one area of surveillance;

second control means connected to the image acquisition device for receiving the acquired sequences of images, for processing at least part of the sequences of images to detect the presence and position of at least one spherical game element in the surveillance area, for sending a control command to move the apparatus to the position of said at least one detected spherical game element, and for instructing the apparatus to collect the detected spherical game element;

interaction means for interacting with a player to perform a controlled and individual delivery of a previously collected spherical game element to said player; and a delivery device controlled by said control means to perform said controlled and individual delivery of a previously collected spherical game element to a said player.

2. A system as set forth in claim 1, wherein said image acquisition device of said first and second movable automatic spherical game element collection apparatuses comprise at least one image acquisition device selected from the group consisting of a CCD camera and a video camera, and wherein the first and second movable automatic spherical game element collection apparatuses are arranged to cover different areas of the gaming area in a complimentary manner.

3. A system as set forth in claim 2, wherein said opto-electric detection and acquisition device comprises a fixed camera directed at the gaming area communicating visual information collected thereby to the first control means, wherein said image acquisition device of the first and second movable automatic spherical game element collection apparatuses include at least one mobile camera and communicate visual information therefrom to said second control means, and wherein one of said at least one mobile camera is rotatable and programmed to acquire player movements.

4. A system as set forth in claim 1, wherein the first control means includes a first electronic system separate from the spherical game element collection apparatuses and the second control means include a second electronic system carried by one of said apparatuses, and wherein the first electronic system and the second electronic system are communicably interrelated via wireless communication.

5. A system as set forth in claim 4, wherein at least one of said electronic systems includes a memory where historical data concerning the operation of the system as a whole are registered, including images and statistical information.

6. A system as set forth in claim 1, wherein said interaction means including a recognition system and an audio system.

7. A system as set forth in claim 1, wherein said recognition system includes a recognizing device for recognizing and interpreting user commands selected from the group consisting of: speech, gestures or a combination thereof, and further wherein said audio system selectively emit sounds and phrases selectable by means of said control means based on the operating status of the apparatus.

8. A system as set forth in claim 1, wherein said delivery means comprises a throwing or launching element for throwing or launching the spherical game element.

* * * * *